US005226344A

United States Patent [19]

Rosemann

[11] Patent Number: 5,226,344

[45] Date of Patent: Jul. 13, 1993

[54] ROTARY CUTTING CYLINDER WITH FLOATING SHEETER BLADE LOCK-DOWN BAR AND METHOD OF MAKING SAME

[76] Inventor: Thomas J. Rosemann, 993 Barbizon, Manchester, Mo. 63021

[21] Appl. No.: 845,676

[22] Filed: Mar. 4, 1992

[51] Int. Cl.[5] ..... B26D 1/12

[52] U.S. Cl. ..... 83/674; 83/346; 76/115; 144/230

[58] Field of Search ..... 76/115, 101.1; 83/663, 83/664, 674, 698, 346; 144/218, 172, 174, 230

[56] References Cited

U.S. PATENT DOCUMENTS

| | | | |
|---|---|---|---|
| 988,227 | 3/1911 | Thomas | 144/230 |
| 1,705,994 | 3/1929 | Peterson | 144/230 |
| 4,715,250 | 12/1987 | Rosemann . | |
| 4,920,843 | 5/1990 | Stromberg et al. | 83/698 |

*Primary Examiner*—Roscoe V. Parker
*Attorney, Agent, or Firm*—Rogers, Howell & Haferkamp

[57] ABSTRACT

A rotary cutting die assembly is comprised of a support roll having a cylindrical exterior surface with a first axial slot formed in the exterior surface and extending a first depth into the support roll, and a second axial slot formed in the exterior surface adjacent the first slot and extending a second depth into the support roll, the second depth being less than the first depth. A cutting blade, shim and lock-down bar are received in the first slot of the support roll. The lock-down bar supports a plurality of set screws oriented at an acute angle relative to the cutting blade. Tightening the plurality of set screws in the lock-down bar causes the set screws to urge the cutting blade and bar apart from each other and into friction engagement against the opposite sidewalls of the first slot, thereby securing the cutting blade and mounting bar in the first slot. Loosening the plurality of set screws enables the cutting blade to be quickly and easily removed from the first slot for adjustment of the blade position or replacement of the blade.

18 Claims, 1 Drawing Sheet

FIG. 1.
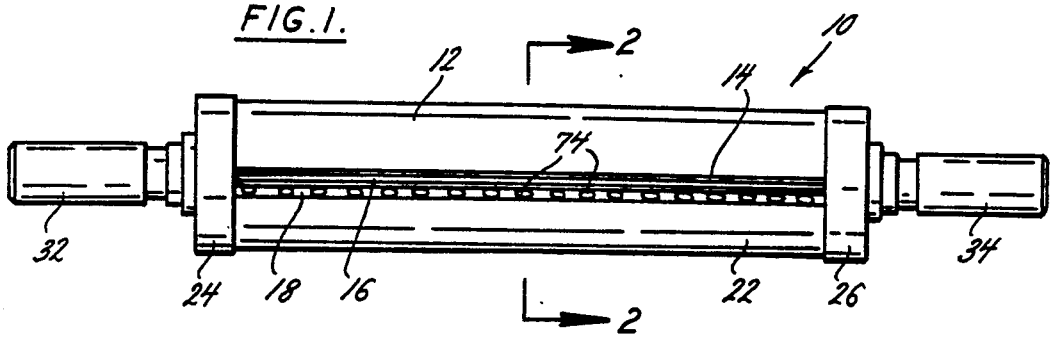
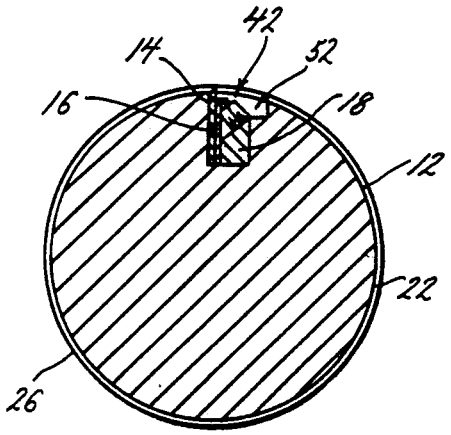
FIG. 2.
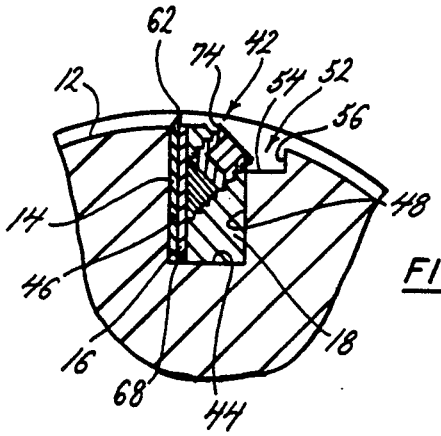
FIG. 3.
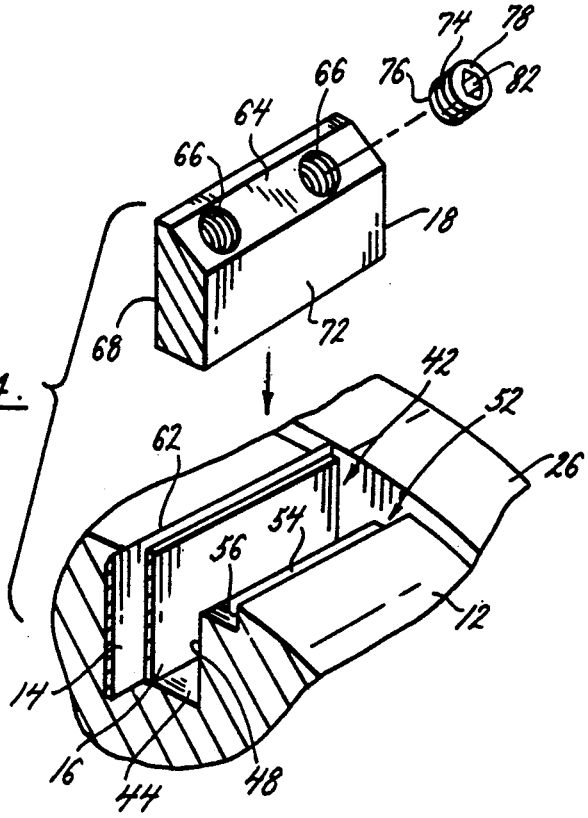
FIG. 4.

ROTARY CUTTING CYLINDER WITH FLOATING SHEETER BLADE LOCK-DOWN BAR AND METHOD OF MAKING SAME

BACKGROUND OF THE INVENTION (1) Field of the Invention

The present invention relates to a rotary cutting die assembly and its method of construction. In particular, the present invention relates to a rotary cutting die assembly comprising a support roll supporting a floating sheeter blade and a lock-down bar assembly that secures the sheeter blade to the support roll, in addition to the method of constructing the rotary cutting die assembly.

(2) Description of the Related Art

Prior art rotary cutting die assemblies employed in sheeter operations, i.e. the cutting of sheets of material from a web of stock material, commonly employ a rotating cutting die cylinder supporting a sheeter blade. The cutting die cylinder and a rotating anvil roll are typically mounted parallel to and adjacent each other on a rotary press. The cutting die cylinder and anvil roll rotate against each other as the web of stock material is passed through the press between the rotating die cylinder and the anvil roll. A pressure assist roll or a load carrying truck or tractor assembly is often employed to exert a downward force on the rotating cutting die cylinder causing it to bear against the anvil roll. As the web of stock material is passed between the rotating die cylinder and the anvil roll, the sheeter blade mounted on the die cylinder cuts the web of material into individual sheets. The size of the sheets produced corresponds to the axial length of the cutting die cylinder and the circumferential distance over the exterior of the die cylinder between adjacent sheeter blades mounted on the cylinder.

The cutting die cylinder of rotary cutting die assemblies of the type used in continuously cutting sheets of material from a web of stock material are commonly formed from a solid steel cylinder. The cutting die cylinder is formed large enough in diameter to provide a circumferential distance between a sheeter blade, or blades, mounted on the cylinder that corresponds to the desired length of the sheets to be cut from the web of stock material. The diameter of the cutting die cylinder is also chosen to provide sufficient strength to the cylinder to prevent any deflection of the cylinder during rotary cutting operations of the press.

The cutting die cylinder is formed with journal shafts protruding from its opposite ends. The journal shafts are used in mounting a gear on the die cylinder, and for rotatably mounting the cylinder in a rotary die cutting press. The gear mounted on the die cylinder meshes with a gear on the anvil roll of the press to deliver a rotational force to the cutting die cylinder and to maintain the die cylinder, the anvil roll, and other operations performed by the rotary cutting press in synchronism.

The cutting die cylinders of prior art rotary cutting die assemblies are typically formed from metal bar stock on a lathe. An axial slot is provided in the surface of the cylinder to receive the cutting blade. In one type of cutting die cylinder, several tangential notches are milled into the cylinder exterior surface adjacent the axial slot. The notches are spatially arranged along the length of the slot and are formed in the cylinder with flat base surfaces that are oriented parallel to the sidewalls of the axial slot. A threaded hole is formed through the base surfaces of each notch and into the slot. Set screws are threaded into the holes and are tightened down in the holes to engage the cutting blade received in the slot and thereby secure the blade in the slot.

Cutting die assemblies of the type described above have been found to be disadvantaged in that several different forming steps are required to construct the die cylinders of the assemblies. The method of constructing the die cylinders is both time consuming and expensive, and requires expensive metal working equipment and skilled laborers.

Rotary cutting die assemblies have been developed in the prior art seeking to reduce the number of forming steps, shortening the manufacturing time, and reducing the equipment and labor required in making the die assemblies. A typical example of this type of prior art rotary cutting die cylinder assembly is disclosed in U.S. Pat. No. 4,715,250. This type of rotary cutting die assembly comprises a die cylinder that is also formed on a lathe. A plurality of longitudinally spaced grooves are formed in the circumference of the cylinder on the lathe. An axial slot is formed in the cylinder traversing the plurality of circumferential grooves. The slot is dimensioned with sidewalls spaced wide enough apart to receive a cutting blade, a stiffening shim, and a mounting bar.

The mounting bar has a rectangular cross section and a plurality of set screws received in threaded holes in the bar at axially spaced intervals along the bar. The circumferential grooves formed in the circumference of the cylinder have an axial spacing complementary to the axial spacing of the set screws in the bar so that a tool can be inserted into the circumferential grooves to tighten and loosen the set screws with the mounting bar received in the axial slot. When the set screws are tightened, they push the cutting blade and mounting bar against the opposite sidewalls of the slot, thereby frictionally engaging the cutting blade and mounting bar in the slot.

Although the rotary cutting die assembly described above is an improvement over earlier die cutting assemblies in that it requires fewer machining steps and correspondingly is less expensive to produce than other cylinder assemblies, the method of forming the die assembly still involves a number of machining steps in forming the axial slot in the surface of the die cylinder and in forming the plurality of circumferential grooves around the surface of the die cylinder. Accordingly, it would be advantageous to provide a rotary cutting die assembly that is produced according to a method that requires a reduced number of machining steps and thereby reduces the time and expense involved in producing the die assembly.

SUMMARY OF THE INVENTION

The rotary cutting die assembly and its method of construction of the present invention overcome disadvantages commonly associated with prior art cutting die assemblies in that significantly fewer machining steps are required in producing the die cylinder of the assembly. The rotary cutting die assembly of the present invention is basically comprised of a die cylinder or support roll, a cutting blade mounted on the support roll, and a lock-down bar mounted on the support roll to secure the cutting blade on the roll. These component parts of the cutting die assembly are adapted to be assembled on a rotary die cutting press of the type employing an anvil roll, against which the rotary cutting die assembly of the present invention bears.

In producing the rotary cutting die assembly of the present invention according to the method of the present invention, the die cylinder or support roll of the assembly is formed in a cylindrical configuration, for example on a lathe. In forming the cylindrical support roll, cylindrical bearer rolls are also formed at opposite axial ends of the support roll and a pair of stub shafts are formed on the opposite distal ends of the support roll outside the bearer rolls. A slot is formed in the exterior surface of the support roll, extending axially across the support roll between the two bearer rolls. This first slot is formed with a predetermined depth and a predetermined width between opposed axial sidewalls of the slot, the width being sufficient to accommodate the cutting blade, the lock-down bar, and a stiffening shim. A second axial slot is then formed in the exterior surface of the support roll adjacent to and communicating with the first slot. The second slot extends over the support roll exterior surface for substantially the same axial length as the first slot, but does not depend into the support roll the same depth as the first slot.

The lock-down bar is constructed having a substantially rectangular configuration except for one corner of the bar that is planed along the bar's axial length and presents an angled surface at the corner of the bar. A plurality of axially spaced threaded holes are formed face. A plurality of set screws are threaded into the threaded bore holes.

The sheeter blade and the lock-down bar are assembled into the first slot in the support roll. The spacing shim is placed between the sheeter blade and the lock-down bar in the support roll slot. The lock-down bar is positioned in the slot with the planed surface of the bar and the exposed driven ends of the set screws adjacent the second slot. In this position of the bar in the first slot, the driven ends of the plurality of set screws received in the bar are accessible by a tool, such as an allen wrench, from the second slot formed in the support roll. The sheeter blade is positioned in the first slot with the cutting edge of the blade projecting from the slot above the exterior surface of the support roll. In these relative positions of the sheeter blade, shim and lock-down bar in the first slot, a tool is inserted into the driven ends of the set screws and the set screws are tightened down, causing the driving ends of the set screws to engage against the shim and urge the sheeter blade and shim away from the lock-down bar in the first slot. This tightening down of the set screws causes the sheeter blade to be urged against one axial sidewall of the first slot while the lock-down bar is urged against the opposite axial sidewall of the slot, thereby securing the sheeter blade in the slot.

BRIEF DESCRIPTION OF THE DRAWINGS

Further objects and features of the present invention are revealed in the following detailed description of the preferred embodiment of the present invention and in the drawing figures wherein:

FIG. 1 is a plan view of the rotary cutting die assembly of the present invention;

FIG. 2 a is elevation view, in section, of the die assembly taken along the line 2—2 of FIG. 1;

FIG. 3 is a partial elevation view, in section, showing the detail of the floating sheeter blade and lock-down bar of the present invention; and FIG. 4 is a partial perspective view of the rotary cutting die assembly of the present invention.

DESCRIPTION OF THE PREFERRED EMBODIMENT

FIG. 1 shows the rotary cutting die assembly 10 of the present invention. The assembly 10 is generally comprised of a support roll 12, a cutting blade 14, a shim 16, and a lock-down bar 18.

The support roll 12 of the assembly is constructed comprising three distinct sections. A middle section 22 of the support roll 1 is formed with a cylindrical exterior surface. This middle or intermediate section of the support roll may be formed on a metal working tool such as a rotary lathe. The diameter of the middle section 22 is substantially constant across the entire axial length of the section. A pair of bearer rolls 24, 26 are formed at the opposite axial ends of the middle section 22. The bearer rolls 24, 26 have slightly larger diameters than the diameter of the middle section 22. The difference in diameters radially spaces the circumferential surfaces of the bearer rolls 24, 26 out from the circumferential surface of the support roll middle section 22 a distance that is substantially equal to the thickness of web material to be cut by the cutting die assembly. The diameter dimensions of the bearer rolls 24, 26 are chosen to maintain the proper spacing of the support roll 12 center axis (not shown) and the center axis of an anvil roll of a rotary cutting press (not shown) employing the assembly of the invention. If the cutting die assembly of the present invention is to be employed in making only partial cuts through the thickness of the web material, the diameter dimensions of the bearer rolls 24, 26 maintain the desired distance between the cutting edge of the cutting blade and the surface of the anvil roll of the cutting press with which the assembly of the invention is employed.

Left and right journal shaft sections 32, 34 extend axially from the opposite ends of the support roll middle section 22. The journal shaft sections are concentric with the support roll middle section and have equal, substantially constant diameters along their axial lengths. The journal shafts are mounted for rotation on a conventional die cutting press, thereby mounting the cutting die assembly 10 for rotation on the press.

A first axial slot 42 is formed in the exterior surface of the support roll middle section 22 extending between the pair of bearer rolls 24, 26. The slot 42 is formed with a bottom wall 44 at a predetermined depth of the slot that is constant along its axial length. The width of the slot 42 is defined by the mutually opposed axial sidewalls 46, 48 of the slot, and is sufficient to accommodate the cutting blade 14, the shim 16, and the lock-down bar 18.

A second slot 52 is formed in the exterior surface of the support roll middle section 22 adjacent the first slot 42. Although the slot 52 is shown having a rectangular cross section, it may have a triangular or other shaped cross section. The second slot 52 extends axially across the exterior surface of the support roll between the pair of bearer rolls 24, 26. The second slot 52 is positioned side-by-side with the first slot 42 and communicates with the first slot. The second slot 52 has a constant depth along its axial length defined by a bottom wall 54. The depth of the second slot 52 is less than the depth of the first slot 42 as can be seen in the drawing figures. The second slot 52 is formed with only one axial sidewall 56 opposite a sidewall 46 of the first slot, with the side of the second slot opposite the sidewall 56 communicating with the first slot 42.

The cutting blade 14 has a beveled cutting edge 62 across its axial length. As seen in FIGS. 2 and 3, the height of the blade 14 is sufficient to cause the cutting edge 62 to protrude above the first slot 42 a sufficient distance to cut completely through a web of material pressed against it. As is best seen in FIG. 3, the height of the cutting blade 14 positions the cutting edge 62 of the blade at the same radial distance above the exterior surface of the support roll middle section 22 as the circumferential surfaces of the bearer rolls 24, 26. In this position of the cutting edge 62, the edge will cut completely through web material passed between the cutting die assembly 10 and an anvil roll of a cutting press on which the assembly is mounted. If it is desirous to produce only partial cuts through web material passed between the die assembly 10 and the anvil roll of the press, a cutting blade having a lesser height must be used so that the cutting edge of the blade does not project the same radial distance above the exterior surface of the support roll middle section 22 as the bearer rolls 24, 26. With such an adjustment of the cutting blade height, the cutting edge will not cut completely through web material passed between the die assembly 10 and the anvil roll of a rotary cutting press.

As is best seen in FIG. 3, the left side of the cutting blade 14 is positioned against the left sidewall 46 of the first slot opposite the second slot 52, and the shim 16 is placed against the right side of the cutting blade. The shim 16 serves to fill a portion of the width of the first slot 42 and also serves in providing some reinforcement to the cutting blade 14 to stiffen the blade and prevent it from warping or bowing in the slot.

The lock-down bar 18 has a generally rectangular cross section except for an angled surface 64 formed at the upper right hand corner of the bar as viewed in the drawing figures. The angled surface 64 extends along the entire axial length of the lock-down bar 16, which is substantially equal to the axial length of the cutting blade 14 and the support roll slots 42, 52. A plurality of threaded bore holes 66 are provided through the lock-down bar 18 and are spatially arranged along its axial length. As seen in the drawing figures, the bore holes 6 extend from the bar angled surface 64 and through the lock-down bar at an angle relative to the left and right sidewalls 68, 72 of the bar.

A plurality of set screws 74 are mounted in the threaded bore holes 66 of the mounting bar. Each of the set screws has opposite driving and driven ends 76, 78, with the driving end 76 of each set screw being positioned toward the bottom of a bore hole 66 and the driven end 78 of each set screw being positioned toward the top of a bore hole. As is best seen in FIGS. 2 and 3, the driving ends 76 of the set screws engage the shim 16 as they project out of the bottoms of the bore holes 66. A hexagonal opening 82 is formed in the driven end 78 of each set screw for receiving a tool, such as an allen wrench, to tighten and loosen the set screws. As seen in FIG. 3, the driven ends 78 of the set screws project from the angled surface 64 of the lock-down bar and into the second slot 52, where the hexagonal openings 82 of the set screws are exposed and accessible to a tool for turning the set screws.

The cutting blade 14, shim 16, and the lock-down bar 18 are assembled into the first slot 42 in the positions shown in FIGS. 2 and 3. In these positions of the component parts of the cutting die assembly of the present invention, the hexagonal openings 82 at the driven ends 78 of the set screws 74 are accessible by a tool in the second slot 52. The tool is inserted into the hexagonal openings 82 and the set screws are turned in the threaded bore holes 66 to urge the cutting blade 14 and shim 16 to the left as viewed in the drawing figures, and to urge the lock-down bar 18 to the right as viewed in the figures. The movement of the cutting blade and shim and the lock-down bar apart from each other by tightening the set screws 74 forces the cutting blade 14 against the left sidewall 46 of the first slot and forces the mounting bar 18 against the right sidewall 48 of the first slot, thereby frictionally engaging the cutting blade 14 and mounting bar 18 in the first slot.

The cutting blade 14 can be quickly and easily removed from the first slot 42 for replacement or adjustment of its position in the slot by loosening the set screws 74 exposed by the second slot 52.

The rotary cutting die assembly 10 of the present invention described above has a simplified construction that enables it to be quickly and easily formed from conventional metal working machinery. The basic steps involved in producing the die assembly include forming a cylindrical exterior surface on the support roll 12, and then forming a pair of side-by-side axial slots 42, 52 across the exterior surface of the support roll, with the first slot 42 being deeper than the second slot 52. The resulting assembly is of simple construction, functions reliably in sheet cutting operations, and is easy to use.

While the present invention has been described by reference to a specific embodiment, it should be understood that modifications and variations of the invention may be constructed without departing from the scope of the invention defined in the following claims.

What is claimed is:

1. A rotary cutting die assembly comprising:

a support roll having a general cylindrical exterior surface with axially opposite first and second ends;

means at the opposite first and second ends of the support roll for mounting the support roll for rotation on a rotary die cutting press;

a first slot formed in the exterior surface of the support roll extending an axial length cross the exterior surface, the first slot having mutually opposed axial sidewalls and the first slot extending into the support roll a first depth from the exterior surface;

a second slot formed in the exterior surface of the support roll extending an axial length cross the exterior surface, the second slot extending into the support roll a second depth from the exterior surface;

a cutting blade received in the first slot, the cutting blade having a cutting edge projecting from the first slot;

means in both the first slot and the second slot for urging the cutting blade against one of the axial sidewalls of the first slot, thereby securing the cutting blade in the first slot; and a bar is received in the first slot between the cutting blade and the second slot, and the urging means urges the cutting blade and the bar apart from each other and against the opposed sidewalls of the first slot.

2. The die assembly of claim 1, wherein:

the second slot has at least one axial sidewall extending the axial length of the second slot.

3. The die assembly of claim 1, wherein:

the axial lengths of the first and second slots are substantially equal.

4. The die assembly of claim 1, wherein:

the first depth is larger than the second depth.

5. The die assembly of claim 1, wherein:

the urging means is mounted on the bar and extends from the bar into the second slot.

6. The die assembly of claim 1, wherein:

the first slot and the second slot are positioned side-by-side on the support roll.

7. The die assembly of claim 1, wherein:

the urging means comprise a plurality of set screws received in the bar and oriented at an angle to the cutting blade, each of the set screws being accessible in the second slot with the cutting blade and bar received in the first slot, the set screws being operable to urge the cutting blade and the bar against the opposite axial sidewalls of the first slot.

8. The die assembly of claim 7, wherein:

a shim is received in the first slot between the cutting blade and the bar.

9. In an improved rotary die cutting assembly having a support roll with a first axial slot formed therein, the first slot having mutually opposed sidewalls and a cutting blade received in the slot, an improvement comprising:

a second axial slot formed in the support roll;

means received in both the first slot and the second slot for urging the cutting blade against one of the opposed sidewalls of the first slot and thereby securing the cutting blade in the first slot; and a bar of predetermined length is received in the first slot adjacent the cutting blade, and the urging means includes a plurality of set screws mounted on the bar and spatially arranged along at least a portion of the length of the bar, the second slot having an axial length substantially equal to the portion of the length of the bar along which the set screws are arranged.

10. The die assembly of claim 9, wherein:

the plurality of set screws are accessible in the second slot for turning the set screws in the bar to urge the cutting blade and bar against the opposed sidewalls of the first slot and thereby secure the cutting blade in the first slot.

11. The die assembly of claim 10, wherein:

the plurality of set screws are received in the bar oriented at an acute angle relative to the cutting blade with the cutting blade and bar received in the first slot.

12. A method of making a rotary cutting die assembly, the method comprising:

forming a support roll having a generally cylindrical exterior surface;

forming a first axial slot in the support roll, the slot having opposed axial sidewalls and a bottom wall;

inserting a cutting blade in the slot;

inserting a bar in the slot, the bar having a plurality of set screws received therein, each set screw being oriented at an angle relative to the cutting blade and each set screw having opposite driving and driven ends, the driving ends being positioned by the bar toward the bottom wall of the slot to exert a driving force on the cutting blade, and the driven ends being positioned by the bar toward an opening of the slot in the support roll exterior surface where they are accessible to be engaged and driven by a tool; and, tightening the set screws with a tool to exert a driving force on the cutting blade, thereby urging the cutting blade toward one sidewall of the slot while urging the bar toward the opposite sidewall of the slot, thereby securing the cutting blade in the slot.

13. The method of claim 12, further comprising:

forming a second axial slot in the support roll so and the driven ends of the set screws are received in the second slot where they are accessible to be engaged and driven by a tool.

14. The method of claim 13, further comprising:

forming the first and second slots side-by-side and communicating with each other.

15. The method of claim 13, further comprising:

forming the first slot with a greater depth than the second slot.

16. The method of claim 13, further comprising:

spatially arranging the plurality of set screws along a length of the bar, and forming the second slot with an axial length substantially equal to the length of the bar along which the set screws are arranged.

17. The method of claim 12, further comprising:

orienting the plurality of set screws in the bar at an acute angle relative to the cutting blade.

18. The method of claim 13, further comprising:

forming the second slot in the support roll with at least one axial sidewall opposing an axial sidewall of the first slot.

* * * * *